US005977921A

United States Patent [19]

Niccolai et al.

[11] Patent Number: 5,977,921

[45] Date of Patent: Nov. 2, 1999

[54] CIRCULAR-POLARIZATION TWO-WAY ANTENNA

[75] Inventors: Luca Niccolai, Osimo, Italy; Antonije Djordjevic, Belgrade, Yugoslavia

[73] Assignee: ALFA Accessori-S.R.L., Italy

[21] Appl. No.: 09/011,913

[22] PCT Filed: Jun. 17, 1997

[86] PCT No.: PCT/IT97/00139

§ 371 Date: Feb. 18, 1998

§ 102(e) Date: Feb. 18, 1998

[87] PCT Pub. No.: WO97/49142

PCT Pub. Date: Dec. 24, 1997

[51] Int. Cl.[6] ..... H01Q 21/29; H01Q 1/24

[52] U.S. Cl. ..... 343/741; 343/866; 343/868

[58] Field of Search ..... 343/741, 743, 343/744, 748, 870, 867, 868, 866

[56] References Cited

U.S. PATENT DOCUMENTS

| | | | |
|---|---|---|---|
| 1,702,039 | 2/1929 | Chireix | 343/741 |
| 4,924,237 | 5/1990 | Honda et al. | 343/702 |
| 5,847,683 | 10/1996 | Wolfe et al. | 343/866 |

FOREIGN PATENT DOCUMENTS

| | | | |
|---|---|---|---|
| 07336133 | 12/1995 | Japan | 21/29 |

*Primary Examiner*—Don Wong
*Assistant Examiner*—James Clinger
*Attorney, Agent, or Firm*—Leonard Bloom

[57] ABSTRACT

An antenna for transmitting and receiving circularly polarized electromagnetic radiation which is configurable to either right-hand or left-had circular polarization. The antenna has a conductive plane and a closed conductive loop spaced from the plane. A signal transmission line is electrically coupled to the loop at a first point and a probe is electrically coupled to the loop at a spaced-apart second point.

13 Claims, 1 Drawing Sheet

CIRCULAR-POLARIZATION TWO-WAY ANTENNA

Figure 2:
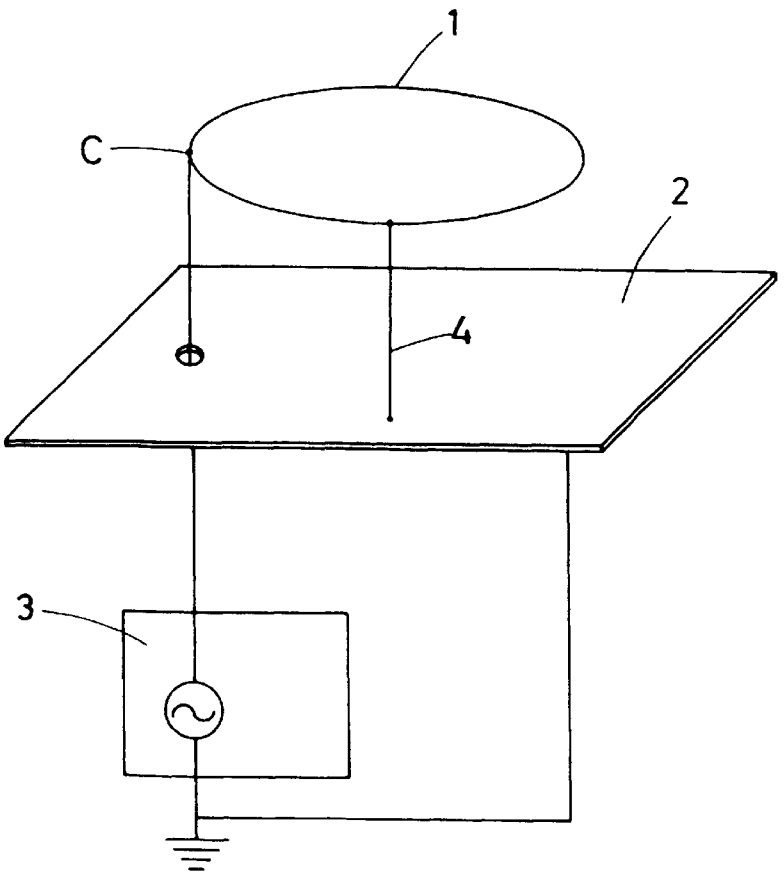

This patent application concerns a circular-polarization two-way (i.e. receiving and transmitting) antenna, for left-hand or right-hand circular polarization.

Circular polarization is typical of satellite systems.

This field is in rapid expansion due to the vast range of possible applications and the relative low cost of implementing these systems.

Parallel to the development of satellite communication systems, the fixed and mobile land devices require increasingly more specialised antennas designed to perform specific functions effectively.

Two types of antennas have to date been used install circular polarization communication and navigation systems on mobile means: the first is the antenna known as the "HELIX" or helicoidal antenna, while the second is known by the experts in the field as the "PATCH" or "MICROSTRIP" antenna.

In helicoidal antennas, circular polarization is obtained by exciting a progressive wave on a helicoidal wire; the direction of the circular polarization (left or right) is determined by the sense of helicoidal wire winding.

The helicoidal antennas have the advantage of being very simple to design and produce and have a considerable band width which ensures low sensitivity; this characteristic of the helicoidal antenna makes the tolerance range wider, making it possible to use inexpensive materials which are easy to obtain on the market. This type of antenna has the added advantage of having a good gain value in an axial direction with an equally good axial ratio that, as the experts in the field know, is the most important reference parameter for the quality of circular polarization.

The disadvantage of helicoidal antennas is their by no means negligible height which makes them inconvenient for certain applications, such as installation on vehicles where low profile antennas are required, obviously because they must be streamlined.

The low profile is the main characteristic of the second type of antenna mentioned above, known as the patch antenna, where circular polarization is obtained by exciting a resonant current distribution on a planar conducting surface. The direction of circular polarization is determined by a precise calculation of the position of the "point of excitation" of the surface.

This type of antenna, however, requires the use of relatively expensive materials, and, above all great precision during setting up and production due to the small tolerances to respect.

The main disadvantage of the patch antenna is that its surface area can hardly be used for mounting other devices, so that it is not possible to use the radiant surface together with components for different applications.

Considering the above state of the art, another type of circular polarization two-way antenna was designed with the aim of offering all the advantages of both of the above antennas, without the disadvantages or application limitations of either.

In the case of the new antenna according to the invention, circular polarization is obtained by exciting a wave along a loop wire, in the sense that its profile has a closed path, which need not necessarily be circular.

Said loop is characterised by a perimeter equal, or approximately equal to a wavelength at the operating frequency.

Said loop wire is mounted above a ground plane, which is parallel to the plane on which the loop lies.

The system consisting of the ground plane and the loop wire gives rise to a resonant structure.

Different ways may be used to determine the polarization (left-hand or right-hand) of the wave; the first consists in exciting the loop wire at two separate points staggered at an angle of 90° with respect to the centre of the loop wire and providing a source in phase quadrature.

Alternatively, the loop wire may be excited at only one point by discriminating one of the two polarizations by means of a passive probe, a directional probe or other suitable means.

By measuring the performance of this type of antenna it is observed that:

- the input resistance, without matching circuits, is between 50–300 Ohm;
- the isolation between the points of excitation is considerably high, namely in the region of 30–50 dB, giving a significant simplification of the phasing circuits.

Figure 1:
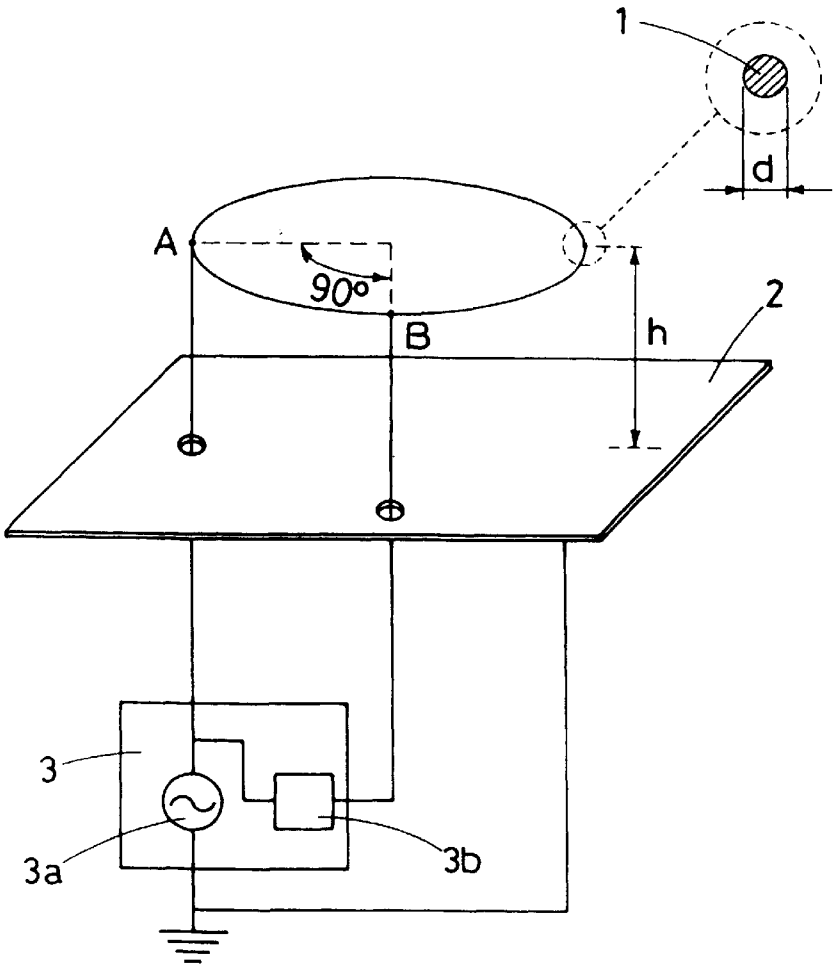

The description of the antenna according to the invention continues with reference to the enclosed drawing intended for purposes of illustration and not in a limiting sense, whereby:

FIGS. 1 and 2 show two embodiments of the antenna according to the invention which differ only in the discrimination means used to determine the direction of circular polarization.

With reference to the above figures, the antenna in question consists of a loop wire (1), whose perimeter is equal, or approximately equal to a wavelength at the operating frequency, mounted above a ground plane (2).

In the preferred embodiments of the antenna according to the invention shown in the figures, the loop wire (1) has a circular profile and lies on a plane parallel to the ground plane (2).

In the structural version shown in FIG. 1, in order to determine the sense of circular polarization, the wire (1) is excited at two points (A and B) which are staggered by 90° with respect to the centre of the loop and an excitation source (3) in phase quadrature is used, consisting of a conventional generator (3*a*) and a conventional hybrid coupler (3*b*).

Using a circular wire (1) having a cross-section with diameter (d) equal to 0.005 wavelength (and whose distance (h) from the ground plane (2) is equal to 0.05 wavelength and considering air as dielectric, it was observed that the antenna constructed as shown in FIG. 1 provides circular polarization with the following parameters:

- an axial ratio under 1 dB in a frequency band of 5% and under 3 dB in a frequency band of 10%;
- a VSWR (voltage standing wave ratio) under 2 (with respect to 100 Ohm);
- a gain in vertical direction equal to approximately 8 dBi.

In the construction version shown in FIG. 2, in order to determine the sense of circular polarization, the wire (1) is excited at only one point (C) and a passive probe (4) is used.

The main advantages of the antenna according to the invention are as follows:

- low sensitivity to production tolerances;
- a band width of intermediate value with respect to those of helix and patch antennas;
- simple and inexpensive to construct;
- the possibility of realising the loop wire on an elevated printed circuit board, made on classical, low-cost substrates;
- small overall height which makes it possible to install the same in vehicles;

reduced transverse dimensions of the loop, whose perimeter may further be reduced with respect to the above wavelength at the operating frequency, by means of loading the loop by lumped shunt capacitors or series inductors, at least at three points along the loop;

the possibility of utilising the space between the ground plane and the plane on which the loop lies, as well as the space circumscribed by the loop, for the installation of additional devices such as antennas or amplifiers without the risk of compromising the performance of the circular polarization antenna appreciably.

We claim:

1. A circular polarization antenna (for left-hand or right-hand polarizations) antenna characterised by:

a ground plane (2);

a wire loop (1) above a ground plane (2) and having a closed path whose perimeter is equal or approximately equal to a wavelength at the operating frequency and through which all transmission and reception of said antenna occur;

an excitation device of the wire (1);

discrimination means to determine the sense of the circular polarization; and means for supporting the wire (1);

wherein said antenna has a high gain or sensitivity along an axis normal to the plane of said wire loop and a reduced off-axis sensitivity.

2. A circular polarization antenna according to the previous claim characterised in that the discrimination means for determining the sense of the circular polarization consist of a passive probe (4); it being provided that the wire loop (1) is excited at only one point (C).

3. A circular polarization antenna according to claim 1) characterised in that the discrimination means for determining the sense of circular polarization consist of a source (3) in phase quadrature; it being provided that the wire loop (1) is excited at two separate points (A and B) staggered at a 90° angle with respect to the centre of the wire loop (1).

4. A circular polarization antenna according to claim 1 characterised in that the wire loop (1) has a circular shape.

5. A circular polarization antenna according to claim 1 claims characterised in that the wire loop (1) lies on a plane parallel to the ground plane (2).

6. A circular polarization antenna according to claim 2 characterised in that the means supporting the wire loop (1) do not coincide with the passive probe (4) nor with the excitation probe.

7. A circular polarization antenna according to claim 2 characterised in that the means supporting the wire loop (1) coincide with the passive probe (4) and/or with the excitation probe.

8. A circular polarization antenna according to claim 1 characterised in that the wire loop (1) is realised on an elevated printed circuit board.

9. A circular polarization antenna according to claim 1 characterised by the inclusion of additional devices, such as antennas, amplifiers and others, installed either on the plane on which the wire loop (1) lies or on the ground plane (2) or in the space between these two planes, or through the loop, in the space circumscribed by the loop.

10. A circular polarization antenna according to claim 1 further comprising lumped shunt capacitive loading of said wire loop, wherein said wire loop perimeter is shorter than said wavelength at the operating frequency.

11. An antenna for transmitting and receiving circularly polarized electromagnetic radiation which is configurable to either right-hand circular polarization or left-hand circular polarization, comprising:

a conductive plane;

a closed conductive loop spaced from said plane by one-twentieth of one wavelength of said electromagnetic radiation and having a perimeter approximately equal to one wavelength of said electromagnetic radiation;

a signal transmission line for carrying all transmission signals to said closed conductive loop and for carrying all reception signals from said closed conductive loop, electrically coupled to said closed conductive loop at a first point on said loop;

a probe means electrically coupled to said closed conductive loop at a second point spaced from said first point for determining which of said right and left-hand polarizations said antenna is configured for;

wherein said antenna transmits and receives signals primarily from zenith angles which are perpendicular to a plane of said closed conductive loop;

whereby a directional, efficient transmission occurs with said compact antenna.

12. The antenna of claim 11 wherein said closed conductive loop is further comprised by a circular wire having a cross-sectional diameter equal to five-thousands of one wavelength of said electromagnetic radiation.

13. The antenna of claim 11 wherein said closed conductive loop further comprises an annulus.

* * * * *